US005595301A

United States Patent [19]

Pütz et al.

[11] Patent Number: 5,595,301

[45] Date of Patent: Jan. 21, 1997

[54] TRANSPORTING HOLDING DEVICE FOR PICTURE FRAMES OR THE LIKE

[75] Inventors: Manfred Pütz; Mathias Szarata, both of Bornheim, Germany

[73] Assignee: Hasenkamp Internationale Transport GmbH & Co. KG, Germany

[21] Appl. No.: 619,923

[22] Filed: Mar. 20, 1996

Related U.S. Application Data

[62] Division of Ser. No. 250,772, May 27, 1994, Pat. No. 5,518,118.

[30] Foreign Application Priority Data

May 29, 1993 [DE] Germany ..... 43 18 045.0

[51] Int. Cl.[6] ..... B65D 85/48

[52] U.S. Cl. ..... 206/449; 206/453; 206/454; 206/586; 206/451; 206/452

[58] Field of Search ..... 206/453, 454, 206/449, 523, 586, 591, 592, 594, 451, 452

[56] References Cited

U.S. PATENT DOCUMENTS

| | | | |
|---|---|---|---|
| 1,004,162 | 9/1911 | Guisquet . | |
| 2,822,921 | 2/1958 | Wilson | 206/451 |
| 2,943,733 | 7/1960 | Poeschl et al. | 206/452 |
| 2,950,001 | 8/1960 | Bucko | 206/454 |
| 3,302,782 | 2/1967 | Pezely . | |
| 3,653,707 | 4/1972 | Pile et al. | 206/454 |
| 3,655,034 | 4/1972 | Stollman et al. . | |
| 4,014,435 | 3/1977 | Rowley et al. | 206/454 |
| 4,047,612 | 9/1977 | Lohmann | 206/454 |
| 4,072,230 | 2/1978 | Mulligan | 206/454 |
| 4,664,254 | 5/1987 | Sitwell et al. | 206/453 |
| 4,892,193 | 6/1990 | Thomas | 206/453 |
| 5,314,159 | 5/1994 | Szarata | 206/806 |

*Primary Examiner*—Marie D. Patterson

*Attorney, Agent, or Firm*—Sixbey, Friedman, Leedom & Ferguson, P.C.; David S. Safran

[57] ABSTRACT

A transporting holding device for picture frames (4) or the like, preferably for installation in a transport crate (1), with several, preferably four, frame securing elements (3), further with two lengthwise adjustable guide devices (5) and two crosswise adjustable guide devices (6). The crosswise adjustable guide devices (6) are guided to be adjustable and able to be immobilized on the lengthwise adjustable guide devices (5), and the frame securing elements (3) are guided to be adjustable on the crosswise adjustable guide devices (6). A greater flexibility is created with such a transporting holding device because the frame securing elements (3) are embodied as a comer bracket for supporting a respective comer of the picture frame (4) and/or as a flat side bracket for supporting a respective part of the edge of the picture frame (4).

12 Claims, 9 Drawing Sheets

TRANSPORTING HOLDING DEVICE FOR PICTURE FRAMES OR THE LIKE

This application is a divisional of application Ser. No. 08/250,772, filed May 27, 1994, U.S. Pat. No. 5,518,118.

BACKGROUND of the INVENTION

1. Field of the Invention

The invention relates to a transporting holding device for picture frames or the like, preferably for installation in a transport crate, with several frame securing elements, and with lengthwise adjustable guide devices and crosswise adjustable guide devices.

The teaching of this invention is explained below based on the preferred application for picture frames. But here it should always be kept in mind that the teaching of the invention can be applied also for-other appropriate art objects such as wood panels, altarpieces, and even relief works and statues.

2. Description of Related Art

Transporting holding devices are used to transport pictures in picture frames. Up to now they are flat crates made of wood into which the picture in the frame is set in soft filling material, in particular in plastic foam. These crates are then transported in an upright orientation.

The picture is surrounded densely on all sides by filling material, so as not to be damaged by vibrations and bumps during transport. Especially on the bottom edge of the frame, on which the full weight of the picture in the frame acts, the padding is problematic, so that transport damages are always common here.

The thick, all-around packing of pictures in frames for transport has another drawback. Pictures, especially old art works, must be exposed to climatic conditions that are as constant as possible. They are thus transported in specially air-conditioned transport vehicles. But, the best air conditioning fails when, because of the thick packing of the picture, the ideal climate produced in the air-conditioned transport chamber cannot become effective at all for the picture itself. The problem, thus, is that a sufficient air exchange through the filling cannot usually be guaranteed.

U.S. Pat. No. 5,314,159 is directed to the problems described above. There, a suspension rail is proposed that is permanently attached to the frame and remains there. It is used first as the attachment base for suspension brackets that can be fastened to it to hang the picture frame. It is further used to attach a carrying rail that can be fastened to the suspension rail. The carrying rail can carry the frame in a transporting holding device, but it can also be used, under certain conditions, to secure the frame on the wall of an exhibition room. The essential thing is the permanently made base on the frame of the picture that is created by the suspension rail.

In the known transporting holding device, a carrying rail is provided in each of the four corners of the frame and form four frame securing elements. They interact there with two lengthwise, adjustable guide devices on the lengthwise sides of a transporting frame and two crosswise, adjustable guide devices guided to be able to be secured, in turn, to the lengthwise adjustable guide devices. Thus, the known transporting holding device is suited for transporting various picture sizes, since the frame securing elements can be adjusted in many ways, like a cross slide.

The transporting holding device for picture frames described above needs frame securing elements embodied as carrying rails, elements that must be securely attached to the respective picture frame.

SUMMARY of the INVENTION

Thus, the primary object of this invention is to provide a transporting holding device having greater flexibility and Which does not require elements that must be securely attached to the picture frame.

The above-described object is achieved for a transporting holding device of the initially mentioned type in which frame securing elements are embodied as comer brackets to support, in each case, a corner of the picture frame, or as flat side brackets to support, in each case, part of the edge of the picture frame. According to the invention, the frame securing elements are configured so that the picture frame itself can be set directly into these frame securing elements. Ultimately, there is, thus, no permanent connection, in the narrow sense, between the picture frame and the frame securing elements but, because of the frame securing elements, the picture frame is fixed in the overall transporting holding device solely because of the action of suitable contact surfaces. Thus, picture frames to which carrying rails cannot be, or are not desired to be, attached, can also be transported.

Finally, the transporting holding device according to the invention represents a solution similar to the thick, all-around packing of pictures in a transporting frame, but with the advantage that, between the frame securing elements embodied as comer brackets or side brackets, enough space always remains to assure sufficient, uniform air conditioning. Further, with the frame securing elements according to the invention, defined supports are created for the picture frame, supports that, in their effect with regard to vibrations and bumps, can be precisely calculated in advance.

These and further objects, features and advantages of the present invention will become apparent from the following description when taken in connection with the accompanying drawings which, for purposes of illustration only, show several embodiments in accordance with the present invention.

Figure 5:
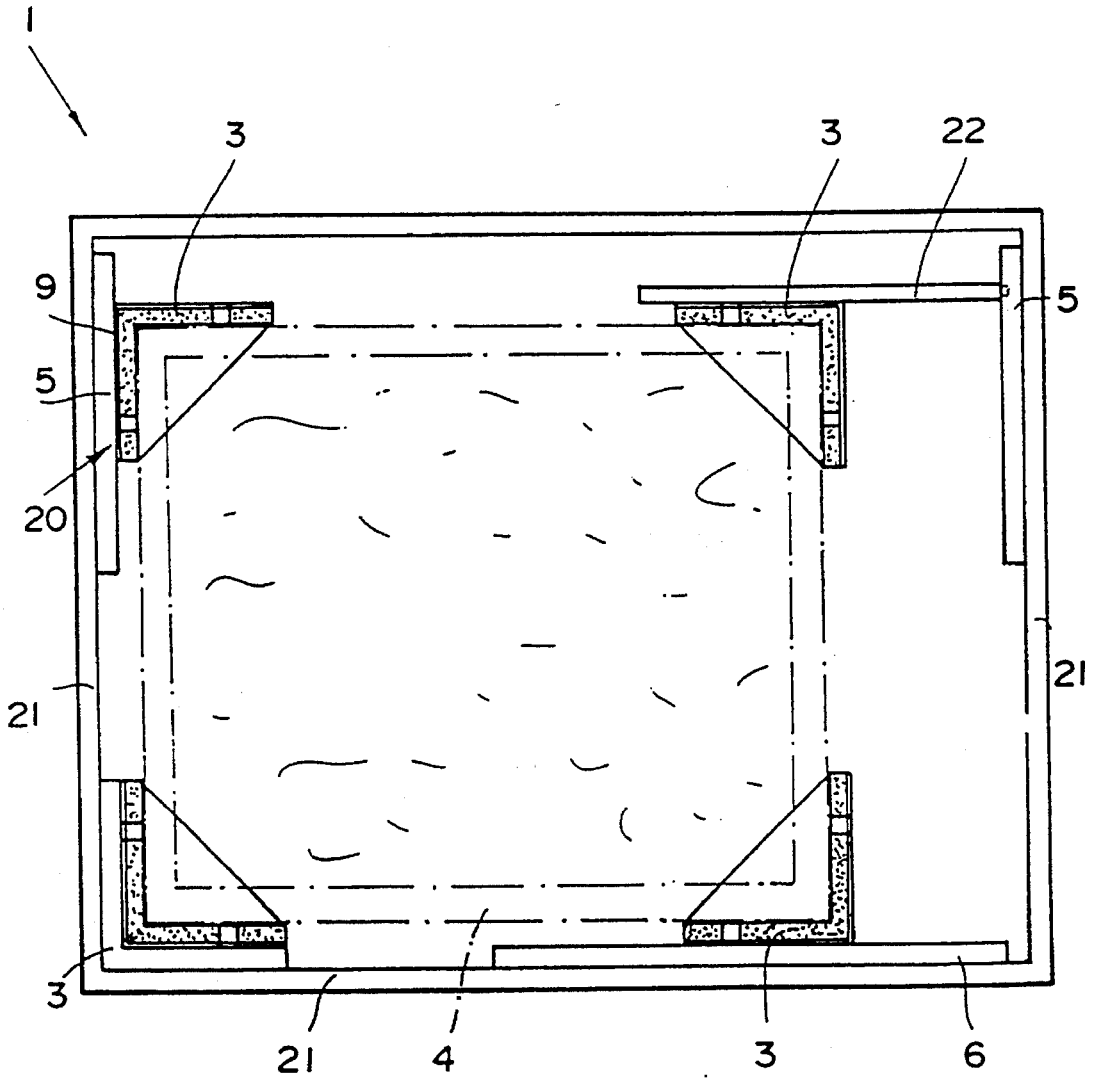
FIG. 5 is a diagrammatic plan view of another embodiment of a transporting holding device according to the invention.
Figure 7:
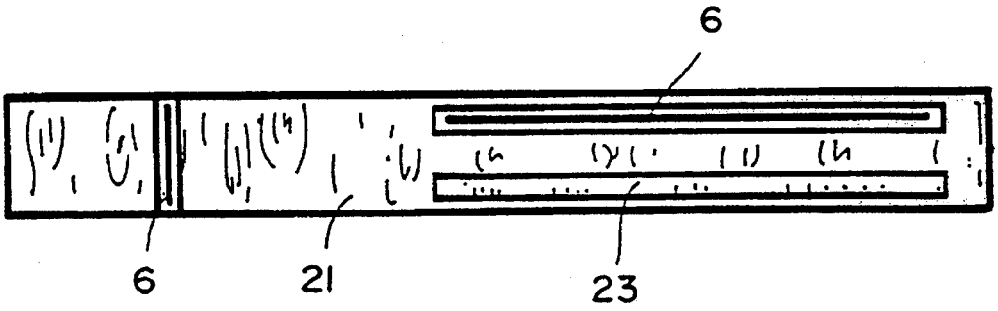
Figure 8:
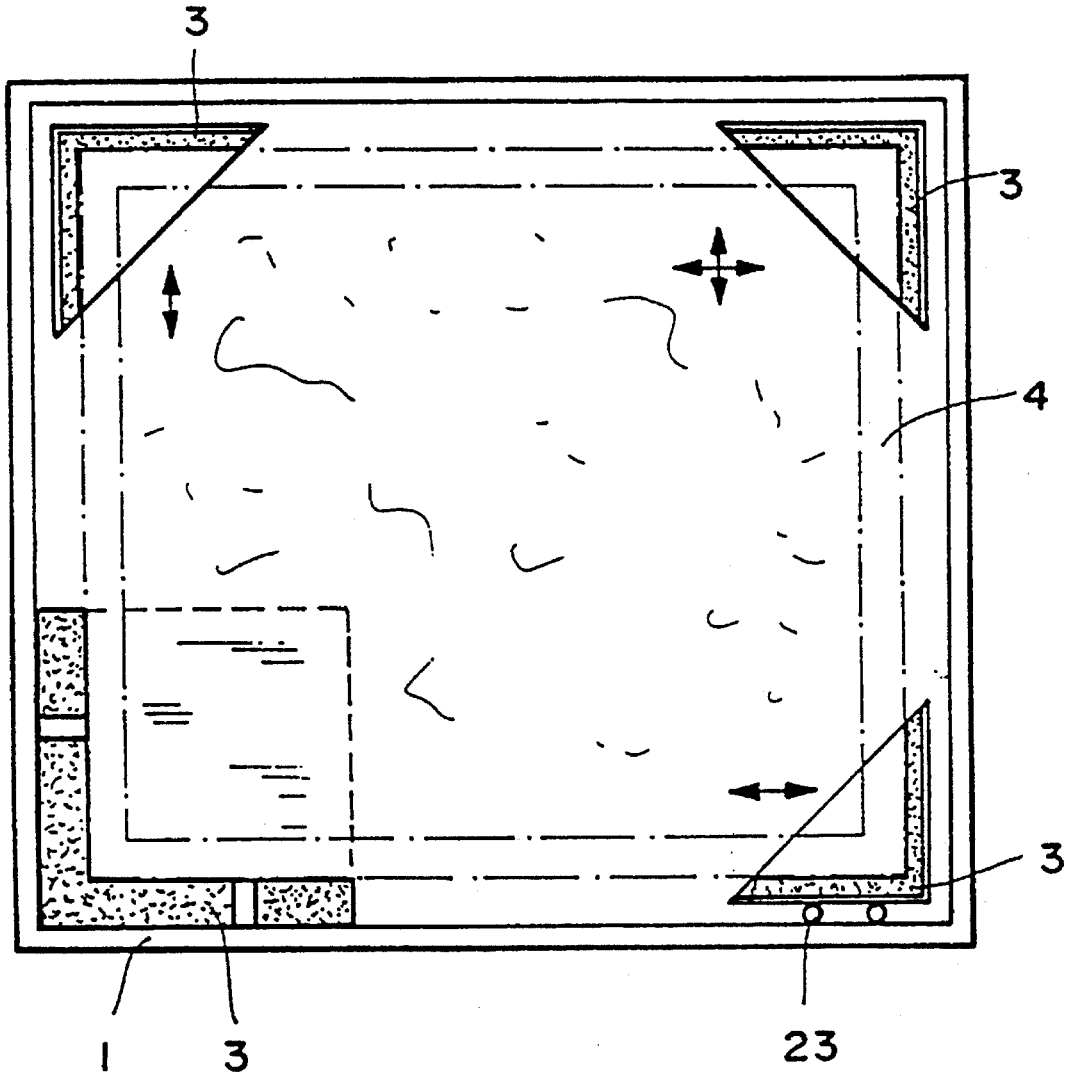
Figure 9:
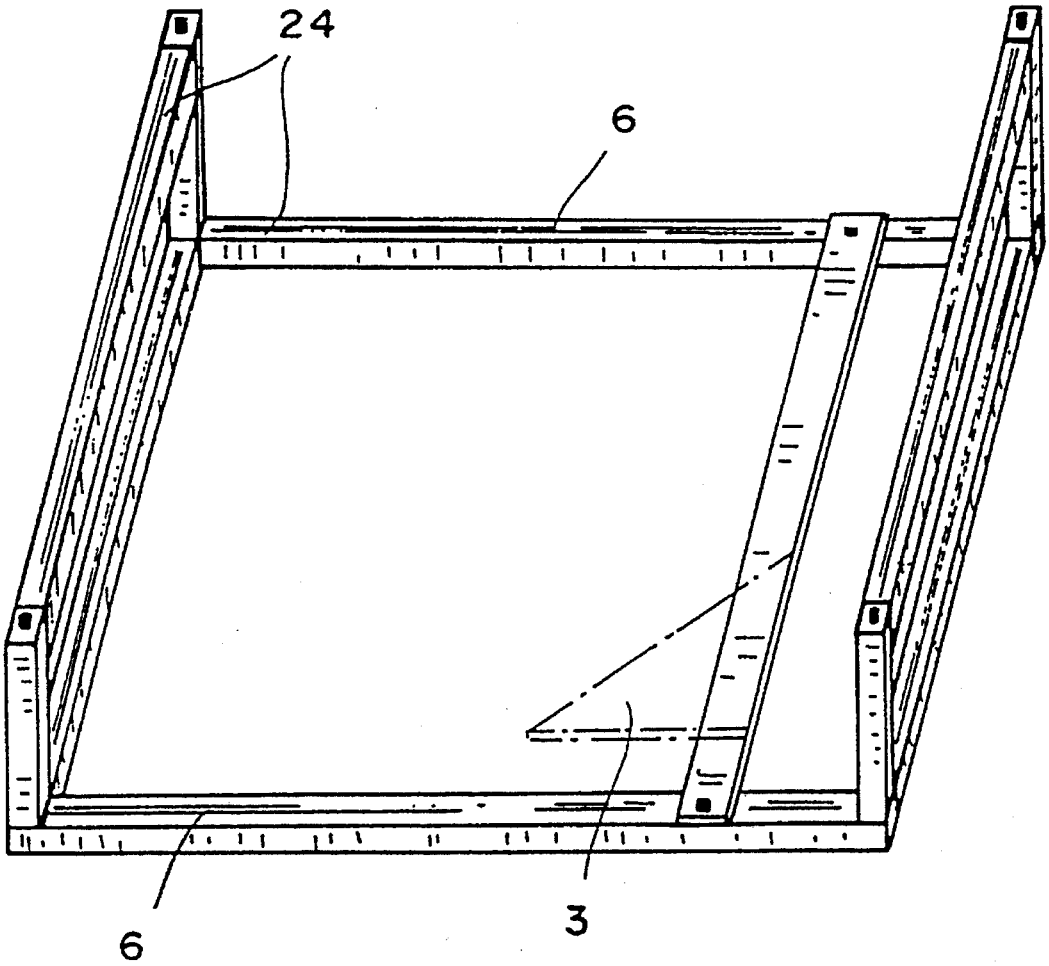
Figure 10:
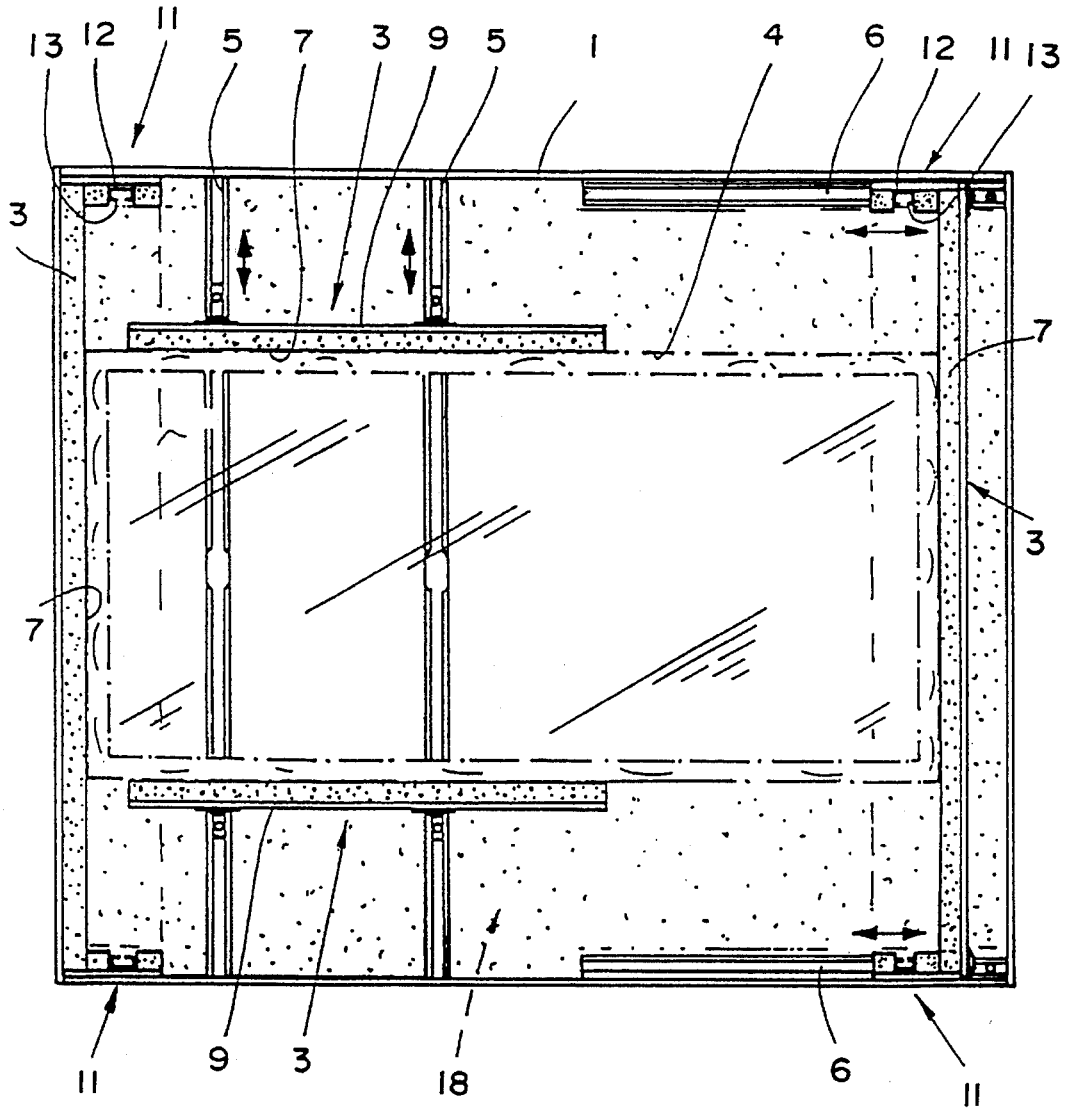
Figure 11:
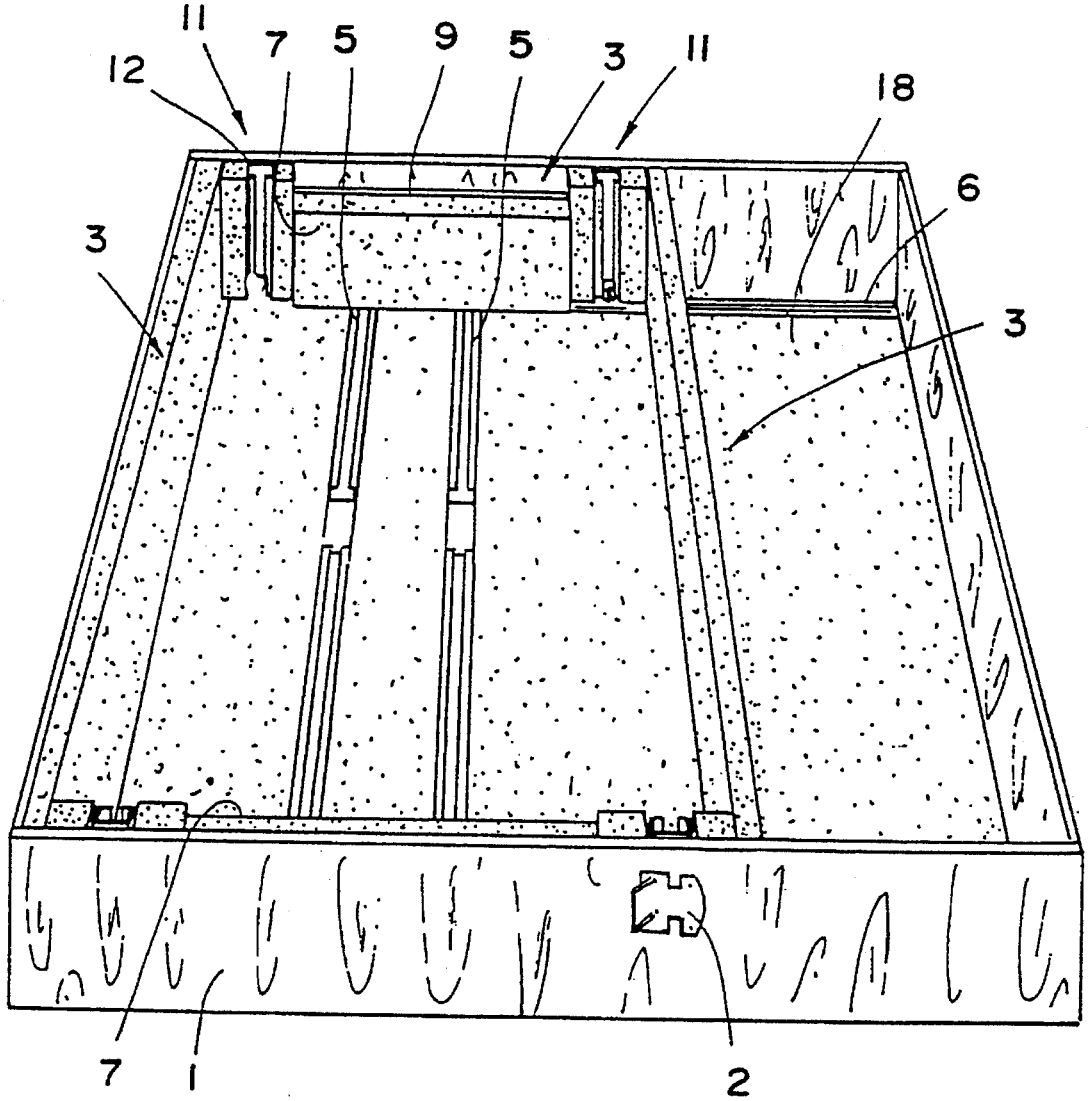

FIGS. *6a* & *6b* illustrate the narrow side of the FIG. 5 transport crate, i.e., the left (*6a*) and the right (*6b*) narrow side viewed from inside the transport crate;

FIG. 7, in a plan view, the bottom, narrow side of the transport crate of FIG. 5;

FIG. 8 shows a complete transporting holding device according to the invention;

FIG. 9 illustrates another embodiment of a transporting holding device according to the invention;

FIG. 10 is a top view of another embodiment of a transporting holding device according to the invention with other frame securing elements; and FIG. 11 is a perspective view of the transporting holding device shown in FIG. 10.

DETAILED DESCRIPTION OF THE PREFERRED EMBODIMENTS

Figure 1:
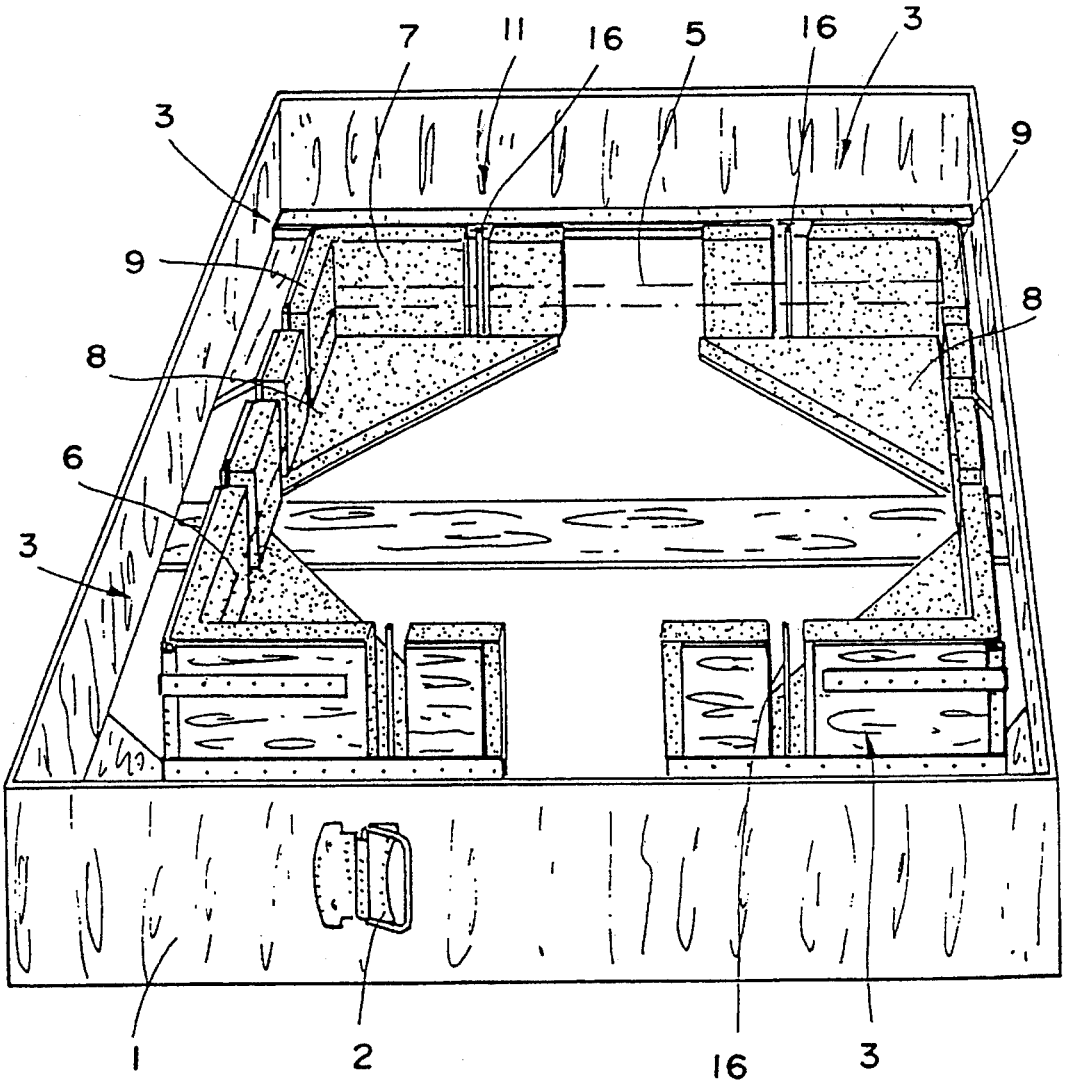
FIG. 1 is a perspective view of a wooden transport crate with built-in transporting holding devices according to a preferred embodiment of the invention.

FIG. 1 shows a wooden transport crate 1 with carrying handles 2 attached to narrow sides thereof. In the crate, there are several, here and according to the preferred teaching, four frame securing elements 3. A picture frame 4 is not shown in FIG. 1, but is in FIGS. 2 and 3. It is also be mentioned here that the term "picture frame" is used here to stand for all types of art objects that are transported in such transporting devices, as it has already been mentioned above.

The four frame securing elements 3 represented in FIG. 1 are parts of a transporting holding device that, in the embodiment represented here and preferred, also has two lengthwise adjustable guide devices 5 and two crosswise adjustable guide devices 6. These are indicated in FIG. 1 only in dot-dash lines; but, in FIG. 2, the arrangement of one lengthwise adjustable guide device 5 and one crosswise adjustable guide device 6 can be seen. In the embodiment represented here, as in the prior art on which the invention is based, the crosswise adjustable guide devices 6 are guided to be able to be adjusted and fixed along the lengthwise adjustable guide devices 5 and the frame securing elements 3 are guided to be able to be adjusted and fixed along the crosswise adjustable guide devices 6.

Figure 2:
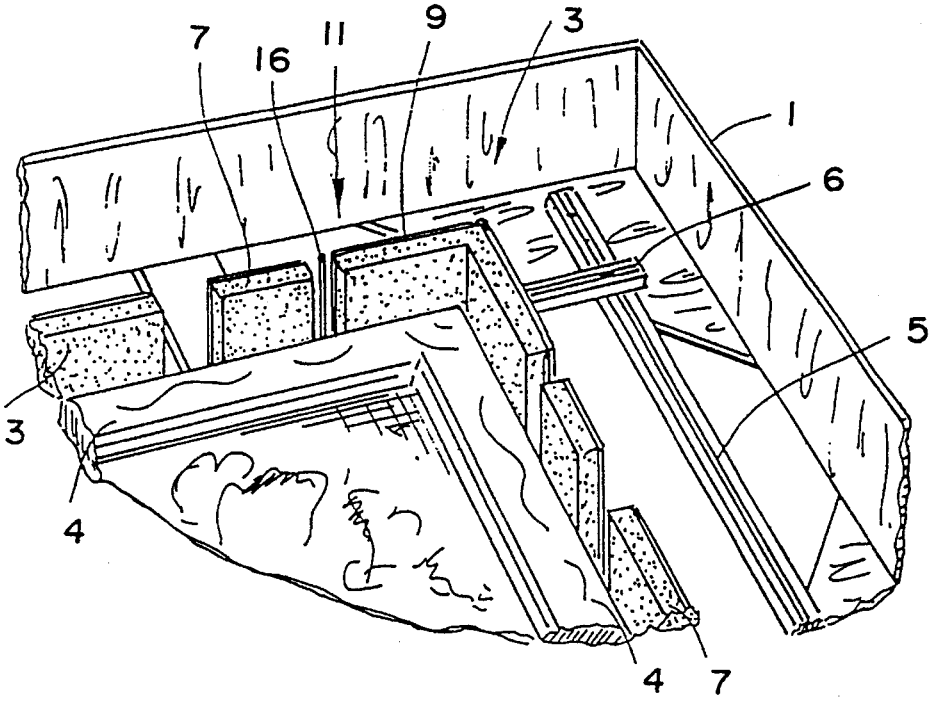
FIG. 2 is a comer area section of the transport crate of FIG. 1 with a picture frame set in it.

In the embodiment that shown in FIG. 2, the lengthwise adjustable guide device 5 and the crosswise adjustable guide device 6 are embodied as profile rails with a T-shaped channel, in which runs a groove block that can be secured in place by a tightening screw (not represented) in the respective T-shaped channel for the purpose of immobilization. The edge of upper frame securing element 3 (which is on top in FIG. 2) is itself held on the crosswise adjustable guide device 6.

The above-described design of the lengthwise and crosswise adjustable guide devices 5, 6, which is known from the prior art, is not necessary for use of frame securing elements 3 according to the invention. The securing elements 3 could also be placed on the lengthwise adjustable guide device 5, or some of them may even be entirely stationary in transport crate 1.

Figure 3:
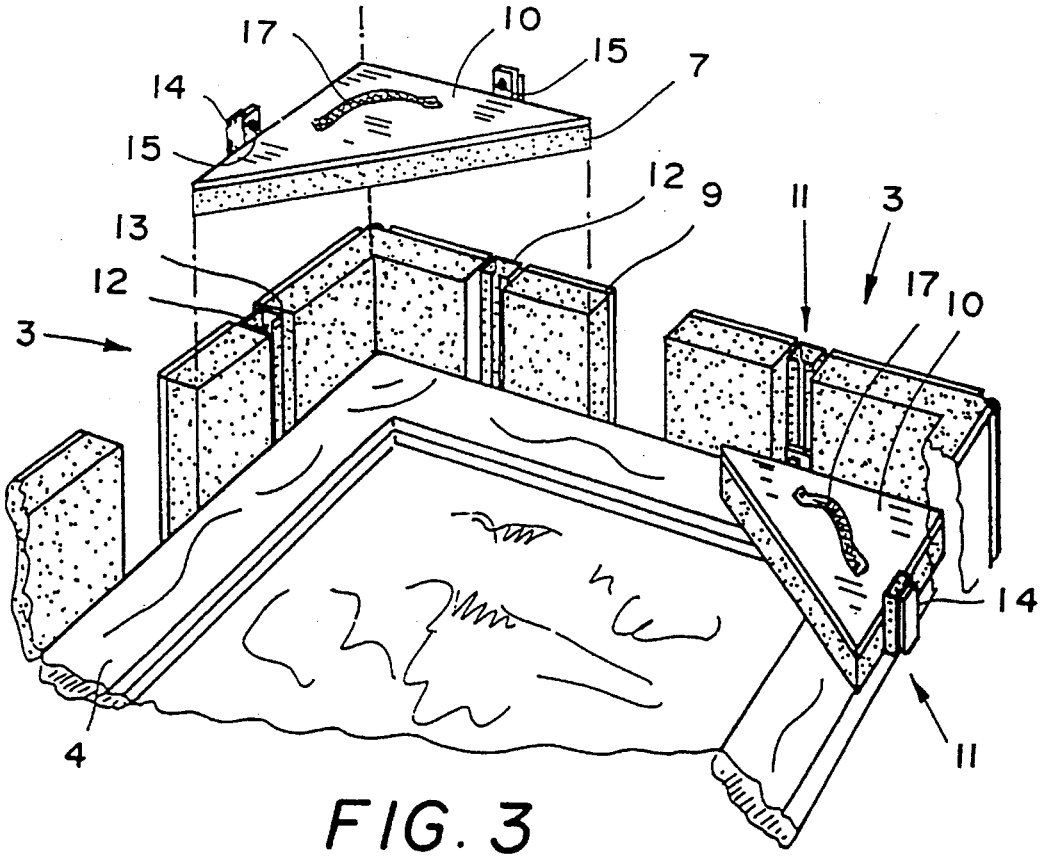
FIG. 3 shows the top end of the transporting holding device of the transport crate of FIG. 1 with a picture frame set in it, partially closed frame securing elements.
Figure 4:
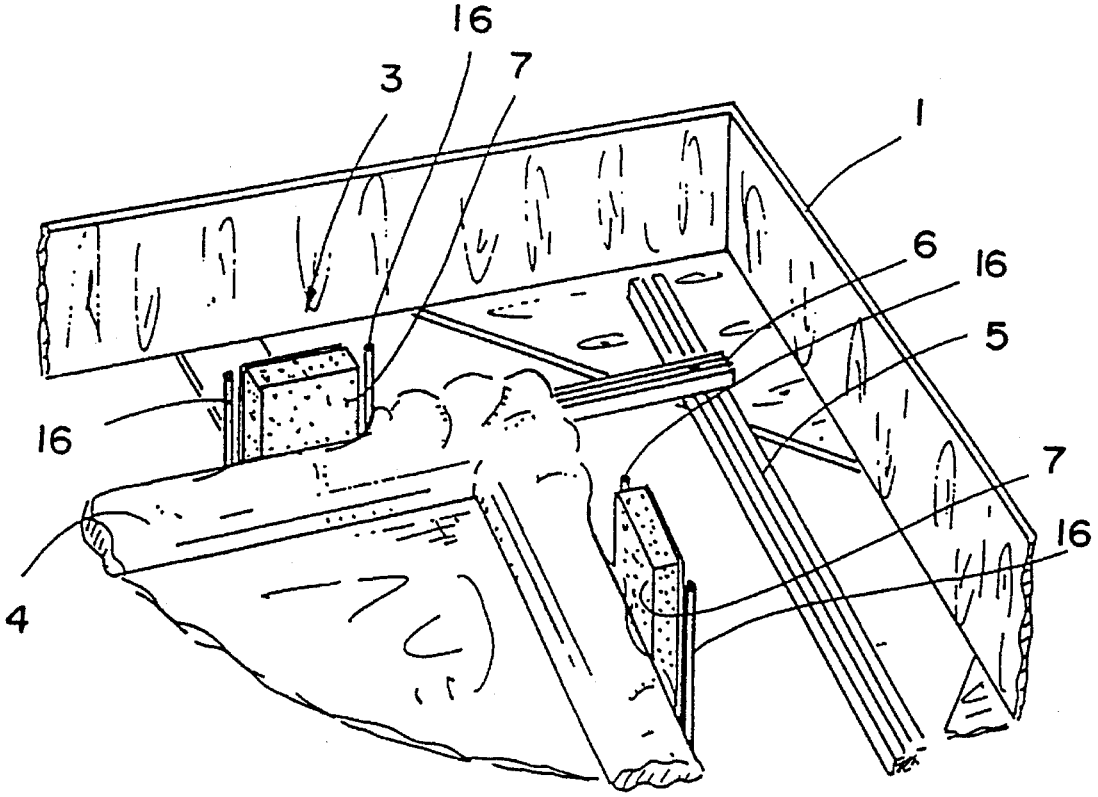
FIG. 4 is a view, corresponding to that of FIG. 2, of another embodiment of a transporting holding device according to the invention.

For the teaching of the invention, first, only the configuration of frame securing elements 3 matter, namely, the fact that frame securing elements 3 are embodied as either comer brackets for supporting a respective comer of picture frame 4 (FIGS. 1, 2 and 3), or as flat side brackets for supporting a respective side edge of the picture frame 4 (FIG. 4). As indicated, the FIG. 4 supporting arrangement is especially suited for frames having a curved outline and frames that have especially sensitive or enlarged comer areas, but is subject to the same basic principle as the structural configuration of the embodiment according to FIGS. 1 to 3.

The comer bracket frame securing elements 3, in the embodiment of FIGS. 1 to 3, naturally, have a very high inherent stability, and from a transport engineering viewpoint, are preferred over the FIG. 4 flat side brackets. However, as indicated, corner brackets cannot be used in all cases.

With respect to choice of material, there is a broad freedom for frame securing elements 3. Elements 3 can be made of wood, aluminum, iron, or plastic. It can be seen, based on the representation in FIGS. 1 to 3, that the inner surfaces of the frame securing element 3 which come into contact with the picture frame 4 are provided with a padded covering 7 or are made of padding material. The back of the padded covering 7 is formed by the frame securing element 3 and the padding is, for example, a relatively stiff plastic foam. The FIG. 4 alternative configuration can be used especially with frame securing elements 3 made of plastic. Nowadays, there are already composite materials that can have quite varying Shore hardnesses across their cross section. Thus, one could arrive at an integrated, one-piece configuration of frame securing element 3 with soft padded surfaces on the inside and a hard spine on the outside. Especially for the comer brackets, that is a very viable solution.

FIGS. 1 to 3 on the one hand, and FIG. 4 on the other hand, show two embodiments that coincide in that frame securing element 3 is U-shaped in cross section, namely has a rear sidepiece 8 used for supporting picture frame 4, a fight-angled edge bar 9 lying on the edge of picture frame 4 and a covering sidepiece 10 which holds the front of the picture frame 4.

FIG. 1 shows four frame securing elements 3, each of which has a triangular sidepiece 8 and angular edge bars 9. The covering front sidepiece 10 is not shown here but is in FIG. 3, and FIG. 2 shows a corner of this transport crate 1 in section with a picture frame 4 set in and with frame securing elements 3 set at the correct intervals. The front sidepieces 10 are both triangular, like rear sidepieces 8. On the right in FIG. 3, front sidepiece 10 has already been placed on top onto picture frame 4 and, secured in place to edge bar 9, and on the left, it can be seen how front sidepiece 10 is set onto the frame securing element 3.

The preferred embodiment represented in FIGS. 1 to 3 starts from the concept that rear sidepiece 8 and edge bar 9 of frame securing element 3 are permanently connected to one another, or optionally are made of a one-piece construction, and that front sidepiece 10 is fastened on edge bar 9 so as to be able to be lifted off and, preferably, detached. In principle, front sidepiece 10 and edge bar 9 could also be connected to one another and connected detachably to rear sidepiece 8, but for the sake of handling, the variant represented is recommended. To be able to handle picture frames 4 of varying thickness, it is further recommended that the distance of the front sidepiece 10 from the rear sidepiece 8 be adjustable. Adjustability is achieved, in the embodiment represented, by suitably adjustable guide devices, that are explained in more detail below.

Not represented is an alternative to securing front sidepiece 10 on edge bar 9, which is distinguished by the use of a pivoting mechanism or a pivoting-pushing mechanism. In this version, front sidepiece 10 would always be connected to edge bar 9 and rear sidepiece 8 of frame securing element 3 (whether embodied as a corner bracket or a side bracket), but could, however, be "flipped" or "snapped" to a certain extent, to set a picture frame 4 in or to take it out again. In contrast to this alternative, in the embodiment represented, securing is achieved with a screw connection.

In particular, the embodiment represented is provided with two screw connections 11 on front sidepiece 10 (on the fight in FIG. 3). To achieve screw connection 11, on the one hand, and to keep the distance of front sidepiece 10 from rear sidepiece 8 easily adjustable, on the other hand, screw connection 11 is comprised of a profile strip 12 with lengthwise T-shaped channel 13, that is attached to the edge bar 9 or is integrated into the edge bar 9, and a groove block 14 that is attached to front sidepiece 10 and has a tightening screw 15 for securement at the proper height in lengthwise T-shaped channel 13. Groove block 14 runs in the top of the T-shape of channel 13 with the screw extending out through the base of the T-shape, so that tightening of the screw clamps block 14 against the profile strip 12 from within. This clamping concept corresponds to that which was explained above for fixing of the lengthwise and crosswise adjustable guide devices 5, 6, as a preferred embodiment.

The variant of a screw connection 11 indicated in FIG. 1, of which here only one guide rail 16 in both sections of edge bar 9 of frame securing element 3 can be seen, can be embodied somewhat less stably but more economically. To the guide rail there belongs, on front sidepiece 10, which is not present in FIGS. 1 and 2, a guide sleeve that can be set to slide on guide rail 16 and that has a tightening screw for securing in place on guide rail 16.

Not represented at all in the drawing is another alternative of a screw connection 11 that works with a threaded rod attached to rear sidepiece 8 in the area of edge bar 9 and projects inside edge bar 9, and the threaded rod is surrounded by a spring element, in particular a compression spring. Against the return pressure of the spring element it is possible, by a tightening screw running on the threaded rod, to set front sidepiece 10 very sensitively on the top side of picture frame 4. Such a return spring could also be recommended for other screw connections 11 that are not represented here. It is also conceivable to achieve a ratchet connection of front sidepiece 10 and edge bar 9 or a snap closure, and then, on front sidepiece 10, depending on the connection area, a spring-loaded catch would have to be provided that makes it possible to reset front sidepiece 10 to open the transporting holding device. Possibly such a design can be suitably used in a pivoting-pushing mechanism to secure front sidepiece 10 to edge bar 9.

Finally, it can be seen from FIG. 3 that a handle 17 is provided on front sidepiece 10 for manipulation of the front sidepiece 10.

It has already been indicated above that, for the teaching of the invention, it is first a question of the configuration of frame securing element 3 to be used, and within the scope of the invention, such can be selected in the most varied way for use in transport crate 1 or in the frame of the transporting holding device. For a given size of picture frame 4, required frame securing elements 3 can be variably arranged in a stationary manner. One, two, three or four of frame securing elements 3 can be arranged adjustably, particularly in an infinitely variable way. For example, with reference to FIG. 5, a frame securing element 3, embodied as a comer element, can be placed fixed in the lower left comer of a transport crate 1, a lengthwise adjustable guide device 5 and a crosswise adjustable guide device 6 can be provided on a lengthwise wall and on a crosswise wall, respectively, for each of second and third diagonally opposite frame securing elements 3, and a fourth frame securing element 3, also embodied as a comer bracket, can be placed diagonally opposite the first, stationary frame securing element 3 on a diagonally lying adjustment guide mechanism or a cross slide, for example, a sliding guide device indicated by the crossed double-arrows in FIG. 8. The flat side brackets mentioned relative to FIG. 4, can also be used, in addition to available corner brackets, as frame securing elements 3, which could be especially suitable for large and heavy picture frames 4 or very sensitive, thin plates.

FIGS. 5 to 8 show the frame securing elements 3 on edge bars 9 being provided with adjustable holding devices 20 that are embodied, in a known way, as groove blocks with tightening screws. Adjustable holding devices 20 are used to suitably arrange the lengthwise adjustable guide devices 5 and crosswise adjustable guide devices 6 that are embodied as conventional profile rails. This thus corresponds to the above-described securing method. The lengthwise adjustable guide devices 5 and the crosswise adjustable guide devices 6 are attached on narrow sides 21 of a wooden transport crate 1. Here it can be seen in FIGS. 6 and 7, in combination with FIG. 5, that the frame securing element lying on the bottom on the left can be laterally adjusted and oriented on crosswise adjustable guide device 6 represented on the bottom in FIG. **6*a*, so that the position of the picture frame is defined. Frame securing element 3 lying above it on the left can be adjusted on lengthwise adjustable guide device 5, represented on top in FIG. 6*a*, in its lengthwise direction, i.e., in height when the transport crate 1 is upright. Frame securing element 3 lying on the bottom right runs on the bottom forming, bottom narrow side 21 in a crosswise adjustable guide device 6. Frame securing element 3 lying on top on the right can be adjusted, as explained further above, like a cross slide, namely, it is adjustable for its part on a cantilever rail 22 by a crosswise adjustable guide device 6, and cantilever rail 22 can be adjusted and immobilized on the right, narrow side 21 of transport crate 1 by a corresponding lengthwise adjustable guide device 5. To support the heavy weight of a heavy picture frame, it can be seen in FIG. 7, on narrow side 21 that, besides crosswise, adjustable guide device 6 for the frame securing element 3 lying on the right on the bottom, there is a sliding guide device 23, for reinforcement, running parallel to it. A corresponding sliding guide device 23 must, of course, be provided on edge bar 9 of comer bracket frame securing element 3. At still higher weights, instead of a sliding guide device, a roller guide device could also be suitable (FIG. 8**).

Figure 6A:
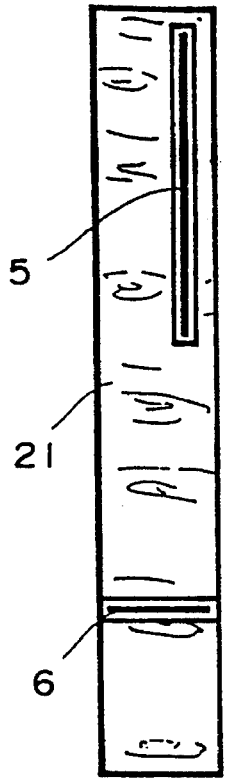
Figure 6B:
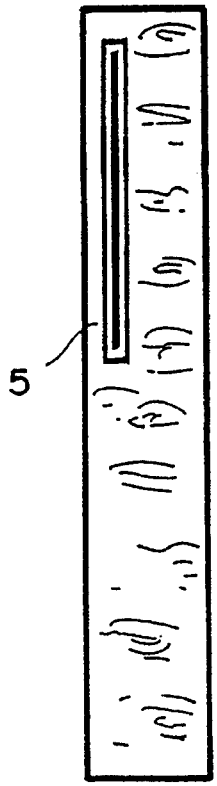

The advantage of the concept represented in FIGS. 5 to 7 is that, with few profile rails at the fight points on narrow sides 21 of transport crate 1, all adjustment possibilities can be covered.

It is of great advantage if frame securing elements 3 and cantilever rail 22 lie flush on the rear wall of transport crate 1 and likewise flush with the cover of transport crate 1, as soon as the latter is put on. Then, frame securing elements 3 (corner brackets) are fixed in a vibration-free manner, as soon as the cover of transport crate 1 is closed.

Frame securing elements 3, in FIGS. 5 to 9, are corner brackets formed out of aluminum. They can be provided on the bottom with detents (bulges) that press, when transport crate 1 is closed, into the rear wall cushioning and thus cause a spatial immobilization. Also, a real immobilization by a locking device could also be achieved. A silicon strip can also be attached to the exposed upper edge of the comer bracket (frame securing element 3), which takes care of additional immobilization.

With the above-described engineering, an optimally simple and secure support, also for heavy transport loads, for picture flames or the like is achieved.

FIG. 8 shows, in overview, again, the overall system as it has been described above, and the arrows in each case indicate the adjustability of respective frame securing elements 3.

FIG. 9 shows an alternative, in which the structural supporting parts of the transporting holding device are not provided by the women walls of a transport crate 1. Here, it is provided rather that lengthwise adjustable guide devices 5 and crosswise adjustable guide devices 6 are attached to a frame that structurally forms transport crate 1 and that is made of profile rails 24, preferably aluminum extrusion profile rails. Such an "open" frame structure with aluminum profile rails is also suitable for certain applications. Not represented is the most suitable securing by clamping rocker levers that act on the groove blocks in the profile rails.

Another embodiment will now be explained with reference to FIGS. 10 and 11. In this case, rear wall 18 of transport crate 1 is provided with a planar padded coveting 7 or is made of padding material. Frame securing elements 3 are embodied solely as edge bars 9 provided with a padded coveting 7 or embodied as padding material and connected to rear wall 18. Rear sidepiece 8 is replaced by a padded covering 7 of the rear wall 18 of transport crate 1. The manner of attachment for front sidepiece 10 to hold picture frame 4 is explained below. What is achieved here is a support of picture frame 4 over its entire surface on one side, and immobilization of picture frame 4 on all of its edges, by frame securing elements 3. The immobilization toward the front can be performed by front covers 10' or in another way, using the above-described profile strip 12 having lengthwise T-shaped channel 13, which is shown in FIGS. 10 and 11 recessed in padding near each of the comer areas, the two on the left in these figures being fixed and the two on the right being movable with the adjacent securing element 3 along guide devices 6.

It is also true for frame securing elements 3 here that they do not necessarily have to be adjustable from the outset. Rather, in the embodiment represented, frame securing elements 3 are wide and plate-like, and are attached on lengthwise and crosswise adjustable guide devices 5, 6 that, for their part, are placed on rear wall 18 (FIG. 11).

The embodiment represented here also shows frame securing element 3 placed stationary on the lower edge of transport crate 1. Three other frame securing elements 3 are guided to be adjustable and are able to be immobilized on various lengthwise and crosswise guide devices 5, 6. Specifically, there are two lengthwise, adjustable guide devices 5 running in padded covering 7 of rear wall 18, above and parallel to the padded covering 7 and to which two laterally adjustable frame securing elements 3 are attached. On the top and bottom edges of rear wall 18 of transport crate 1, overlying padded covering 7, there are crosswise running, adjustable guide devices 6 that carry a fourth frame securing element 3 which is parallel to the fixed first securing element 3. A picture frame 4, which can be securely braced or inserted here, is indicated in dot-dashed outline.

Further, here the packing of a picture frame 4 can be achieved starting from one corner of transport crate 1 to various sizes by placing, on the left bottom comer of the embodiment from FIG. 10, two frame securing elements 3 with padded coverings 7 running in the bracket and making two other frame securing elements 3, in contrast, adjustable along corresponding lengthwise, adjustable guide devices 5 or crosswise, adjustable guide devices 6.

Overall, the design according to the invention offers numerous flexible application possibilities for picture frames 4, which make it possible to reuse transport crates 1 or the transporting holding device according to the invention to a large extent.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

We claim:

1. Transporting holding device for picture frames comprising a plurality of frame securing elements, first guide devices and second guide devices for said securing elements, said second guide devices being oriented crosswise relative to said first guide devices; wherein the first and second guide devices are located on a rear wall of a transport crate; wherein the frame securing elements are in the form of flat side brackets for supporting respective parts of the edges of a picture frame; wherein the frame securing elements are provided with means for adjusting the position thereof in a lengthwise direction of the first and second guide devices and means for immobilizing the frame securing elements in positions to which they are adjustable along-the first and second guide devices.

2. Transporting holding device according to claim 1, wherein a padding material is provided on at least inner surfaces of the flat side brackets for providing cushioned contact with the picture frame.

3. Transporting holding device according to claim 2, wherein the rear wall the transport crate is provided with planar padding material and the first and second guide devices are located on the rear wall of the transport crate.

4. Transporting holding device according to claim 3, wherein the fiat side brackets have a wide plate-shaped configuration.

5. Transporting holding device according to claim 3, wherein the flat side brackets forming the frame securing elements are provided with front side pieces for supporting a front side portion of the picture frame.

6. Transporting holding device according to claim 2, wherein the flat side brackets have a wide plate-shaped configuration.

7. Transporting holding device according to claim 2, wherein the flat side brackets forming the frame securing elements are provided with front side pieces for supporting a front side portion of the picture frame.

8. Transporting holding device according to claim 1, wherein the rear wall of the transport crate is provided with planar padding material and the first and second guide devices are located on the rear wall of the transport crate.

9. Transporting holding device according to claim 8, wherein the flat side brackets forming the frame securing elements are provided with front side pieces for supporting a front side portion of the picture frame.

10. Transporting holding device according to claim 8, wherein the flat side brackets have a wide plate-shaped configuration.

11. Transporting holding device according to claim 1, wherein the flat side brackets have a wide plate-shaped configuration.

12. Transporting holding device according to claim 1, wherein the flat side brackets forming the frame securing elements are provided with front side pieces for supporting a front side portion of the picture frame.

* * * * *